US007191613B2

(12) United States Patent
Lee

(10) Patent No.: US 7,191,613 B2
(45) Date of Patent: Mar. 20, 2007

(54) TURBO FAN AND AIR CONDITIONER HAVING THE SAME APPLIED THERETO

(75) Inventor: Nee Young Lee, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 12 days.

(21) Appl. No.: 10/302,929

(22) Filed: Nov. 25, 2002

(65) Prior Publication Data

US 2003/0209024 A1 Nov. 13, 2003

(30) Foreign Application Priority Data

May 8, 2002 (KR) ..... 2002-0025389

(51) Int. Cl.
*F25D 23/12* (2006.01)

(52) U.S. Cl. ..... 62/262

(58) Field of Classification Search ..... 62/262, 62/407; 454/125, 201, 190
See application file for complete search history.

(56) References Cited

U.S. PATENT DOCUMENTS

| | | | | |
|---|---|---|---|---|
| 4,647,271 | A | | 3/1987 | Nagai et al. |
| 4,768,349 | A | * | 9/1988 | Lin ..... 62/243 |
| 5,775,123 | A | | 7/1998 | Wakayama et al. |
| 5,967,748 | A | * | 10/1999 | Jang ..... 415/211.1 |

FOREIGN PATENT DOCUMENTS

| | | | | |
|---|---|---|---|---|
| EP | 0377847 | A1 | | 12/1989 |
| EP | 0 377 847 | A1 | | 7/1990 |
| EP | 0450272 | A2 | | 1/1991 |
| EP | 0 450 272 | A2 | | 10/1991 |
| EP | 0916905 | A2 | | 5/1999 |
| GB | 2107396 | A | | 9/1982 |
| GB | 2167851 | A | | 10/1985 |
| JP | 407004389 | A | * | 1/1995 |
| JP | 8-289504 | A | | 11/1996 |
| JP | 10141686 | A | * | 5/1998 |
| JP | 410153192 | A | * | 6/1998 |
| JP | 11-218097 | A | | 8/1999 |
| JP | 11-294384 | A | | 10/1999 |
| JP | 2001-12389 | A | | 1/2001 |
| JP | 2001-295793 | A | | 10/2001 |

* cited by examiner

*Primary Examiner*—Melvin Jones
(74) *Attorney, Agent, or Firm*—Birch, Stewart, Kolasch & Birch, LLP

(57) ABSTRACT

Turbo fan having an axial fan flow characteristic, and an air conditioner having the turbo fan applied thereto, the turbo fan including a hub 30 having a boss 33 coupled to driving means, a plurality of blades 40 arranged along an edge of the hub 30 at fixed intervals, each having a part of an inner side end 41 thereof connected to the edge, and a shroud 50 having an inlet, an outlet, and a wall between the inlet and the outlet formed to enclose at least a part of an outer side end 43 of each of the blades 40 for inducing an air discharge direction the same with an axial direction of the driving means.

34 Claims, 5 Drawing Sheets

TURBO FAN AND AIR CONDITIONER HAVING THE SAME APPLIED THERETO

This nonprovisional application claims priority under 35 U.S.C. § 119(a) on Patent Application No. 2002-0025388 filed in KOREA on May 8, 2002 and 2002-0025389 filed in KOREA on May 8, 2002, which is herein incorporated by reference.

BACKGROUND OF THE INVENTION

1. Field of the Invention

The present invention relates to a turbo fan and an air conditioner having the same applied thereto, and more particularly, to a turbo fan having a flow characteristic of an axial fan, and an air conditioner having the turbo fan employed as a fan for an outdoor unit.

2. Background of the Related Art

In general, the air conditioner circulates cooled, or heated air in a room for comfort. The air conditioner requires many fans for producing air flow passing through heat exchangers. The fans may be axial, or centrifugal.

The axial fan draws and discharge air in a direction parallel to an axial direction, and the centrifugal fan draws air in a direction parallel to the axial direction, but discharges the air in a centrifugal direction. In the centrifugal fans, there are a sirocco fan, and a turbo fan. A related art turbo fan will be explained, briefly.

Referring to FIG. 1, the related art turbo fan is provided with a hub 1 having a boss 2 in a central part for coupling with a driving shaft of a motor, a plurality of blades 3 each fitted in a radial direction along a periphery of the hub 1 prolonged in an axial direction, and a shroud 4 fitted to one ends of the blades 3. The shroud 4 has an inlet part 4*a* parallel to an axial direction to form an inlet, and a curved part 4*b* bent outward from the inlet part 4*a* having one ends of the blades 3 connected thereto.

The operation of the turbo fan will be explained, briefly. When the hub 1 is rotated by a rotating force of the motor, an air flow is produced by forms of the blades 3. That is, after being drawn through the inlet of the shroud 4, the air is discharged through spaces between blades 3, i.e., in a centrifugal direction, which is best shown in FIG. 1 by arrows.

The turbo fan, having the foregoing flow characteristic, has a high efficiency and a low noise compared to other kind of fans, particularly, to the axial fan.

However, the turbo fan is employed only in an indoor unit of the air conditioner due to the flow characteristic. It is because, as there are many refrigerating cycle elements, such as an outdoor heat exchanger, and a compressor, fitted in the outdoor unit of the air conditioner, the axial fan, producing an axial air flow, is more favorable than the turbo fan for reducing a total size of the outdoor unit. Owing to this reason, the turbo fan having a high efficiency and less noise can not be employed in the outdoor unit.

Particularly, in a unit type air conditioner, having the indoor unit and the outdoor unit fitted in one unit, the foregoing problem becomes very serious. That is, the unit type air conditioner, not only transmits the noise form the axial fan to the room, but also has a substantially great power consumption caused by the low efficiency of the axial fan.

In the meantime, unitary formation of the related art turbo fan is not easy. It is because molding of related art turbo fan is not possible owing to a structure of the related art turbo fan. Consequently, the related art turbo fan is fabricated by separate formation, and welding of the hub 1, the blades 3, and the shroud 4, which has a complicated fabrication process, and costs high, at the end.

SUMMARY OF THE INVENTION

Accordingly, the present invention is directed to a turbo fan and an air conditioner having the same applied thereto that substantially obviates one or more of the problems due to limitations and disadvantages of the related art.

An object of the present invention is to provide a turbo fan having a flow characteristic of an axial fan.

Another object of the present invention is to provide a turbo fan which can be formed as one unit.

Further object of the present invention is to provide an air conditioner having a turbo fan with a flow characteristic of an axial fan employed as a fan of an outdoor unit therein.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the turbo fan includes a hub having a boss coupled to driving means, a plurality of blades arranged along an edge of the hub at fixed intervals, each having a part of an inner side end thereof connected to the edge, and a shroud having an inlet, an outlet, and a wall between the inlet and the outlet formed to enclose at least a part of an outer side end of each of the blades for inducing an air discharge direction the same with an axial direction of the driving means.

The hub includes a cone part projected toward the inlet of the shroud having the boss at a fore end, and a hollow part in a back surface of the cone part in communication with the outlet of the shroud. The hub further includes at least one opening for making a front side of the hub and the hollow part in communication.

The shroud includes an inlet part forming an inlet opening, an outlet part forming a discharge opening and enclosing an outside surface of the blades, and a sloped part between the inlet part and the outlet part. The shroud further includes a height of a stepped part between the inlet part and the sloped part.

The inlet part of the shroud has an inside diameter smaller than an inside diameter of the discharge part, and equal to, or greater than an outside diameter of the hub. The hub, the blades, and the shroud are injection molded as one unit.

The blade includes a backward curved blade in an inlet side, and a forward curved blade in an outlet side, for improving an air flow characteristic.

Accordingly, the air drawn through the inlet of the shroud is discharged through an outlet of the shroud guided by the blades. That is, the air is discharged, not between spaces between the blades, i.e., in a centrifugal direction, but parallel to an axial direction. Therefore, the turbo fan of the present invention has a high efficiency and a low noise proper to the turbo fan while a flow characteristic of an axial fan.

In another aspect of the present invention, there is provided an air conditioner including a cabinet having one space in communication with a room, and the other space in communication with an outside of the room, an indoor heat exchanger fitted in the one space of the cabinet for heat exchange with room air, an indoor fan fitted in the one space of the cabinet for making the room air to flow toward the indoor heat exchanger forcibly, an outdoor heat exchanger fitted in the other space of the cabinet for heat exchange with external air, an outdoor fan fitted in the other space of the cabinet for making the external air to flow toward the outdoor heat exchanger forcibly, and a turbo fan fitted in the other space of the cabinet for drawing, and discharge air in an axial direction to make the external air to flow toward the outdoor heat exchanger, forcibly.

In this instance, the turbo fan has all the characteristics explained before. In addition to this, the turbo fan further includes a slinger ring fitted along an outside circumferential surface of the shroud for splashing condensed water to the outdoor heat exchanger when the shroud is rotated.

Accordingly, as the turbo fan is employed as the outdoor fan, noise of the outdoor fan can be reduced substantially, and power consumption of the air conditioner can be reduced.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings. In explanation of the embodiments of the present invention, identical parts will be given the same name and symbols, and iterative explanation of which will be omitted.

Figure 1:
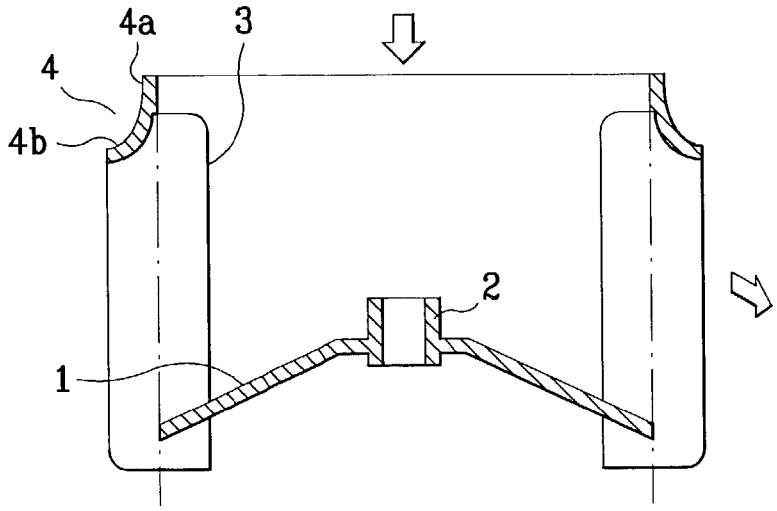
FIG.1 Prior Art
FIG. 1 illustrates a section of a related art turbo fan.
Figure 2:
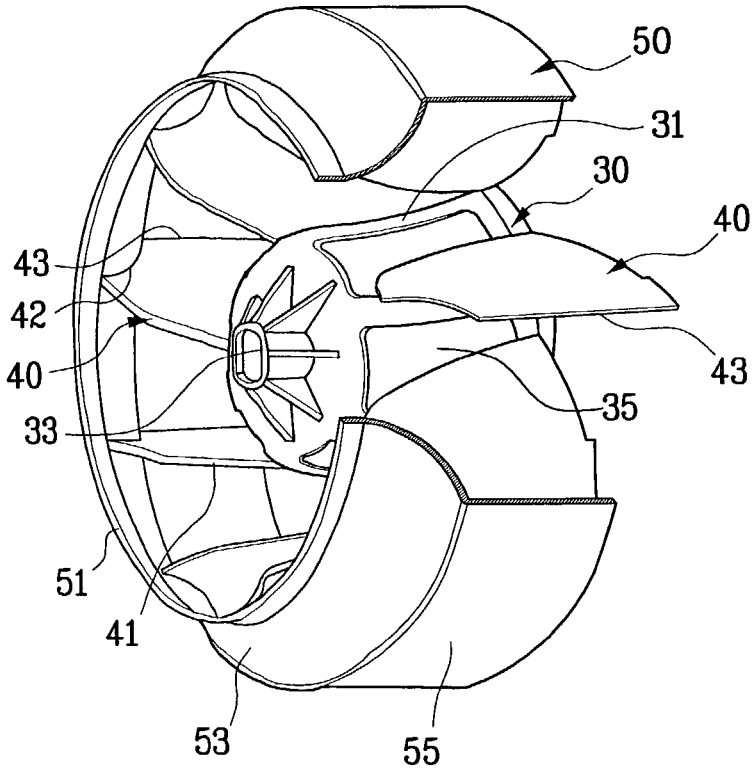
FIG. 2 illustrates a perspective view, with a partial cut away view of a turbo fan in accordance with a preferred embodiment of the present invention.

A turbo fan in accordance with a preferred embodiment of the present invention will be explained, with reference to FIGS. 2–6. FIG. 2 illustrates a perspective view, with a partial cut away view of a turbo fan in accordance with a preferred embodiment of the present invention, FIG. 3 illustrates a perspective view of a back side of the turbo fan in FIG. 2, and FIG. 4 illustrates a section of the turbo fan in FIG. 2.

Figure 3:
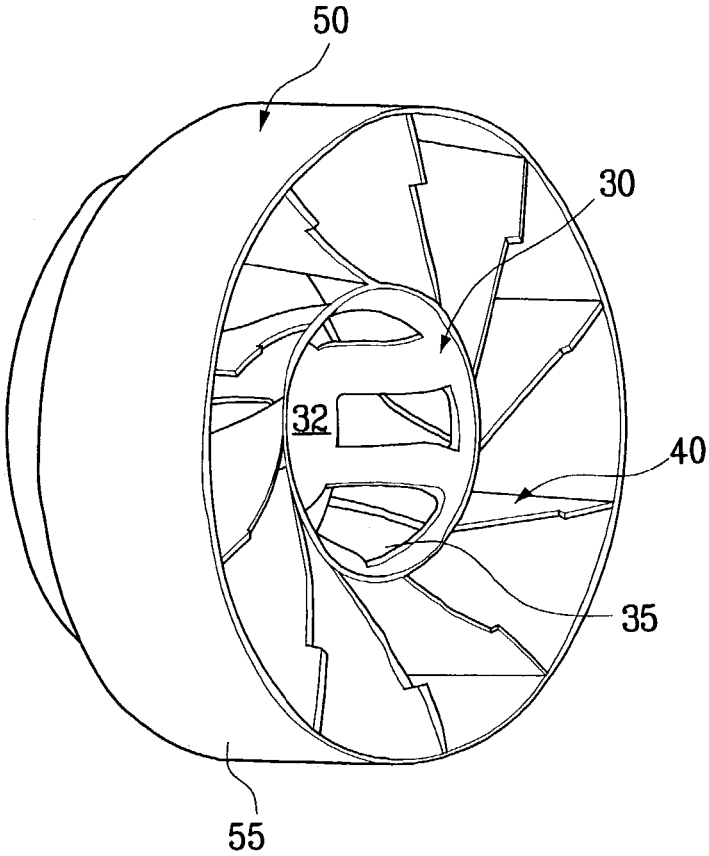
FIG. 3 illustrates a perspective view of a back side of the turbo fan in FIG. 2.
Figure 4:
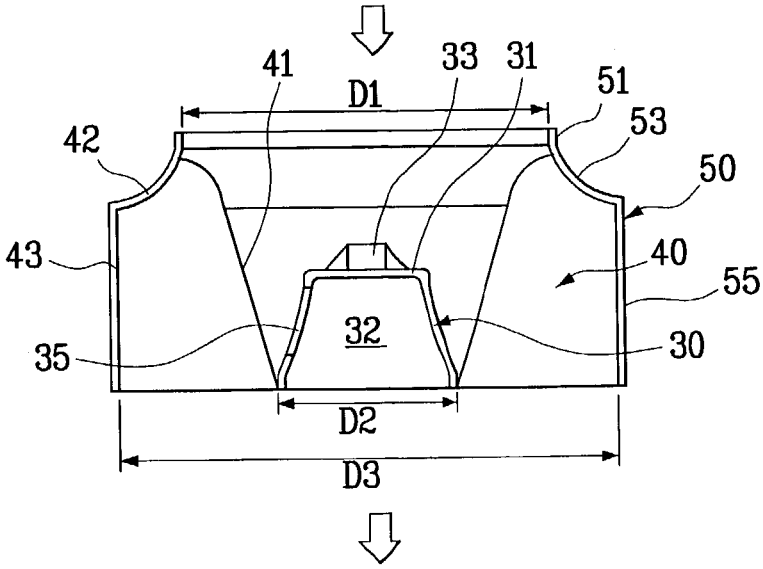
FIG. 4 illustrates a section of the turbo fan in FIG. 2.

Referring to FIGS. 2–4, the turbo fan includes a hub 30 coupled to driving means (not shown), a shroud 50 accommodating the hub 30 inside thereof having an inlet and an outlet in opposite sides thereof, and a plurality of blades 40 between the hub 30 and the shroud 50.

The hub 30 includes a cone 31 projected toward the inlet of the shroud 50, and a hollow part 32 in a back surface of the cone 31. The cone 31 has a boss 33 at a fore end for coupling with a driving shaft of a motor. The hollow part 32 forms a discharge passage of the air together with the shroud 50.

The cone part 31 of the hub 30 has a plurality of openings 35, to make a front part of the hub 30 in communication with the hollow part 32, for intake of a portion of the air drawn through the inlet of the shroud 50 into the hollow part 32 through the openings 35, and direct discharge to an outside of the turbo fan. The openings 35 also reduce a total weight of the turbo fan.

The blades 40 are arranged around the hub 30 at fixed intervals. The blade 40 has a part of one inner end fixed to an edge of the hub 30, and an outer end 43 fixed to an inside surface of the shroud 50. The inner end may be fixed to the hub 30 at an angle along the edge. It is preferable that an entire outer end 43 of the blade 40 is fixed to the inside surface of the shroud 50, for prevention of the air drawn through the inlet from being discharged through a space between blades 40, i.e., in a centrifugal direction.

It is preferable that the blade 40 has blade forms varied with positions in the blade. That is, the blade 40 has a backward curved form in an inlet side, and a forward curved form in the outlet side along an axis direction. The backward curved blade, having a tip part thereof curved backward with respect to a rotation direction, is favorable for increasing an air pressure. The forward curved blade, having a tip part thereof curved forward with respect to a rotation direction, is favorable for increasing an air flow rate. The blade 40 has the backward curved part up to approx. 40–80% from the edge of the inlet side.

The shroud 50 leads the air to be discharged in an axial direction. The shroud 50 will be described in detail. The shroud 50 includes an inlet part 51 forming an inlet opening, an outlet part 55 forming a discharge opening, and a sloped part 53 between the inlet part 51 and outlet part 55. The inlet part 51 has a form of a ring parallel to the axial direction. The inlet part 51 has an inside diameter D1 smaller than an inside diameter D3 of the outlet part 55.

The sloped part 53, extended outward from the inlet part 51, has inlet side outer ends 42 of the blades 40 fixed to the inside surface thereof. For this, the sloped part 53 has a form in conformity with the inlet side outer ends 42 of the blades 40, with a curved surface having a preset curvature.

The outlet part 55, extended along a length of the blades 40 from the sloped part 53, has the inside surface the outer ends 43 of the blades 40 fixed thereto. The outlet part 55 leads the air flow to be in the axial direction by guiding the air toward the outlet side. The outlet part 55 is not required to be extended to a rear end of the blade 40 as far as the air flow direction is axial. However, as explained, it is the most preferable that the outlet part 55 is extended to the rear end of the blade 40. Alike the inlet part 51, though the outlet part 55 is cylindrical parallel to the axial direction, the outlet part 55 may be diverged as it goes the farther toward the outlet side.

Figure 5:
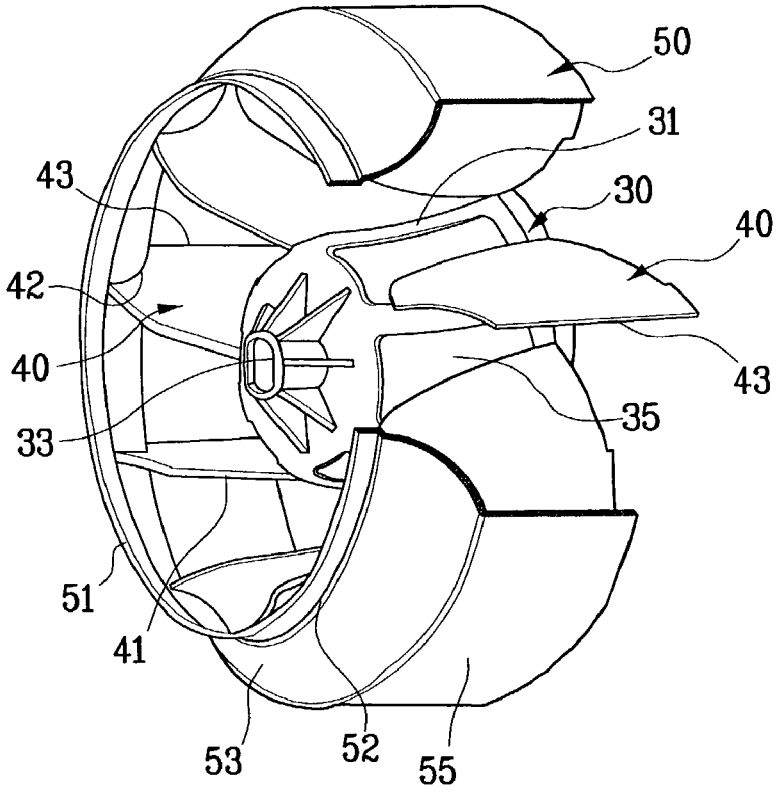
FIG. 5 illustrates a perspective view, with a partial cut away view of a turbo fan in FIG. 2 having a variation of shroud.

In the meantime, there may be variations of the shroud 50. FIG. 5 illustrates a perspective view, with a partial cut away view, of a turbo fan in FIG. 2 having a variation of shroud, and FIG. 6 illustrates a section of the turbo fan in FIG. 5.

Figure 6:
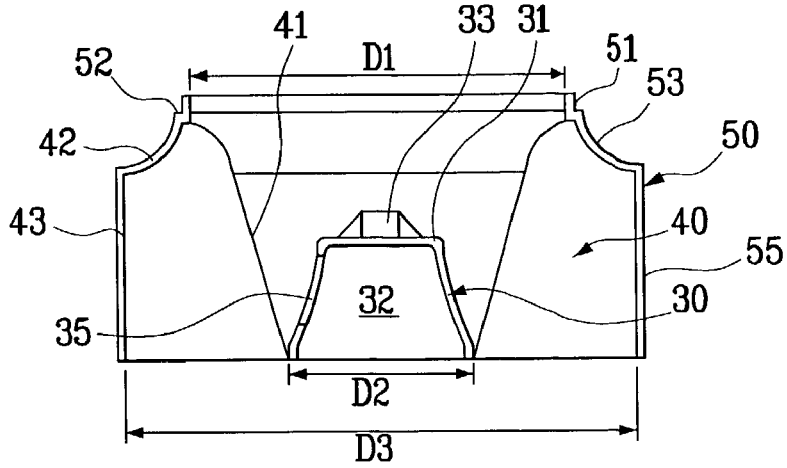
FIG. 6 illustrates a section of the turbo fan in FIG. 5.

Referring to FIGS. 5 and 6, the shroud may further include a stepped part 52 between the inlet part 51 and the sloped part 53. The stepped part 52 is extended from the inlet part 51 in a direction perpendicular to the axial direction to a width.

In the meantime, the shroud 50 and the blades 40 of the turbo fan of the present invention are molded as one unit, or alternative to this, the hub 30 may be molded, and inside ends 41 of the blades 40 may be welded to the edge of the hub 30. By the way, if sizes of the shroud 50 and the hub 30 are selected appropriately, the shroud 50, the blades 40, and the hub 30 may be molded as one unit as many as one wishes. That is, as shown in FIGS. 4 and 6, when the inside diameter D1 of the inlet part 51 of the shroud 50 is at least equal to or greater than the outside diameter D2 of the hub 30, the shroud 50, the blades 40, and the hub 30 cab be molded as one unit.

The operation of the turbo fan of the present invention will be explained.

Upon driving the motor, the hub 30 rotates, together with the blades 40 and the shroud 50. When the blades 40 rotates, there is a pressure built up difference between the inlet and outlet of the shroud 50, which causes to draw air through the inlet, forcibly.

Then, the air flows toward the outlet side guided by the blades 40, and discharged backward through the outlet. In this process, the air flows along the backward curved blades at first, and then, along the forward curved blades starting from a certain point. In this instance, there are, not only a substantial reduction of a fan load owing to the characteristic of the backward curved blade, but also an adequate rate of air flow secured owing to the characteristic of the forward curved blades.

In this process, a portion of the air flows to the hollow part 32 through the openings 35 in the hub 30, and directly discharged backward. In this instance, the air is not discharged in the centrifugal direction because the outlet part 55 of the shroud 50 encloses the outer ends of the blades 40.

As can be noted from above description, the turbo fan of the present invention has a flow characteristic of an axial fan. That is, both suction and discharge directions of the air are the same with the axial direction, which, as described later, provides a basis for employing the turbo fan as a fan of an outdoor unit of an air conditioner.

Owing to the foregoing characteristic, the turbo fan of the present invention is applicable to a fan in an indoor unit, and a fan in an outdoor unit without any limit regardless of kinds of the air conditioner. That is, the turbo fan of the present invention has a characteristic proper to a turbo fan, as well as a flow characteristic of an axial fan. Accordingly, the turbo fan of the present invention can provide various advantages when applied to the air conditioner.

Figure 7:
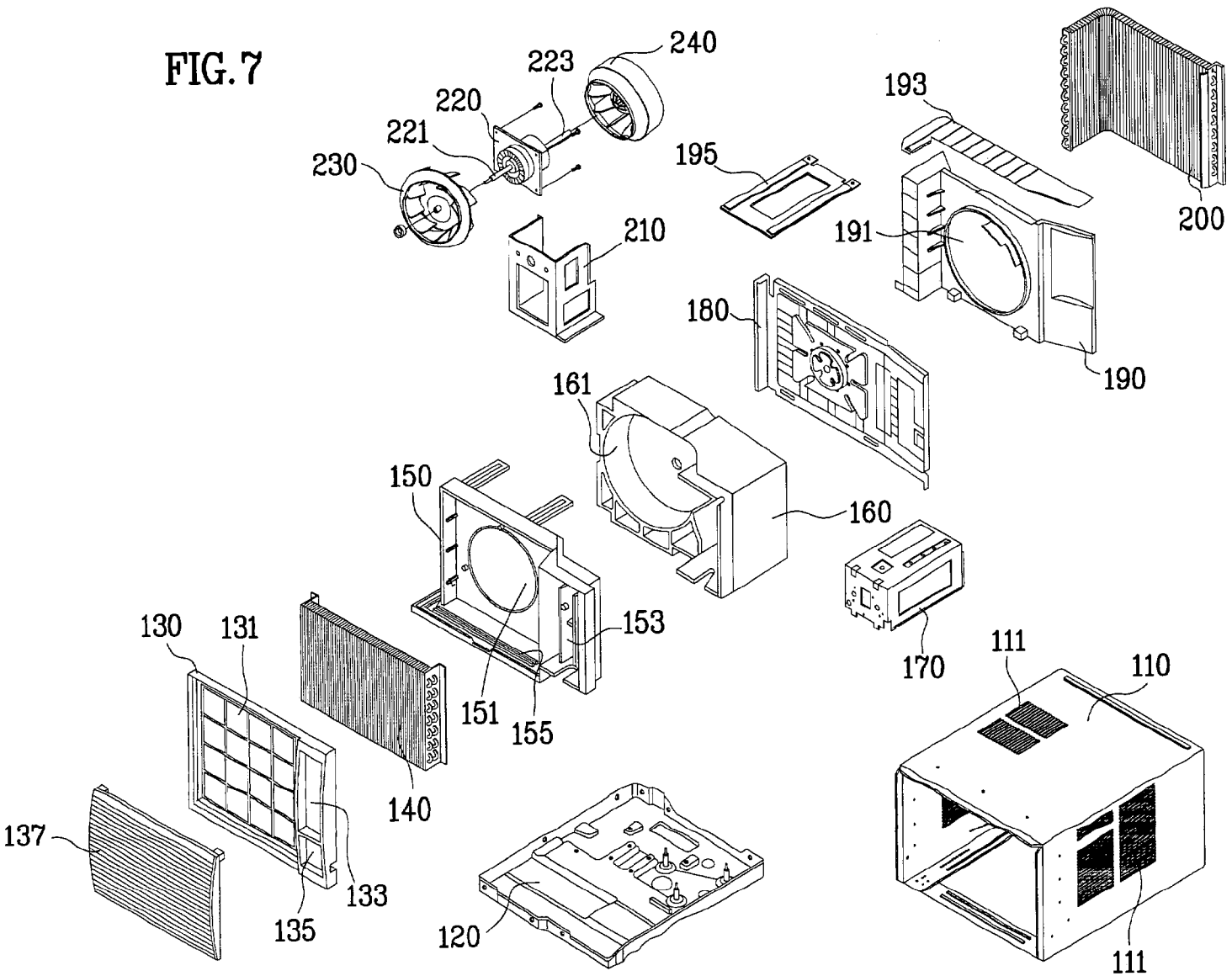
FIG. 7 illustrates a perspective disassembled view of an air conditioner in accordance with a preferred embodiment of the present invention.
Figure 8:
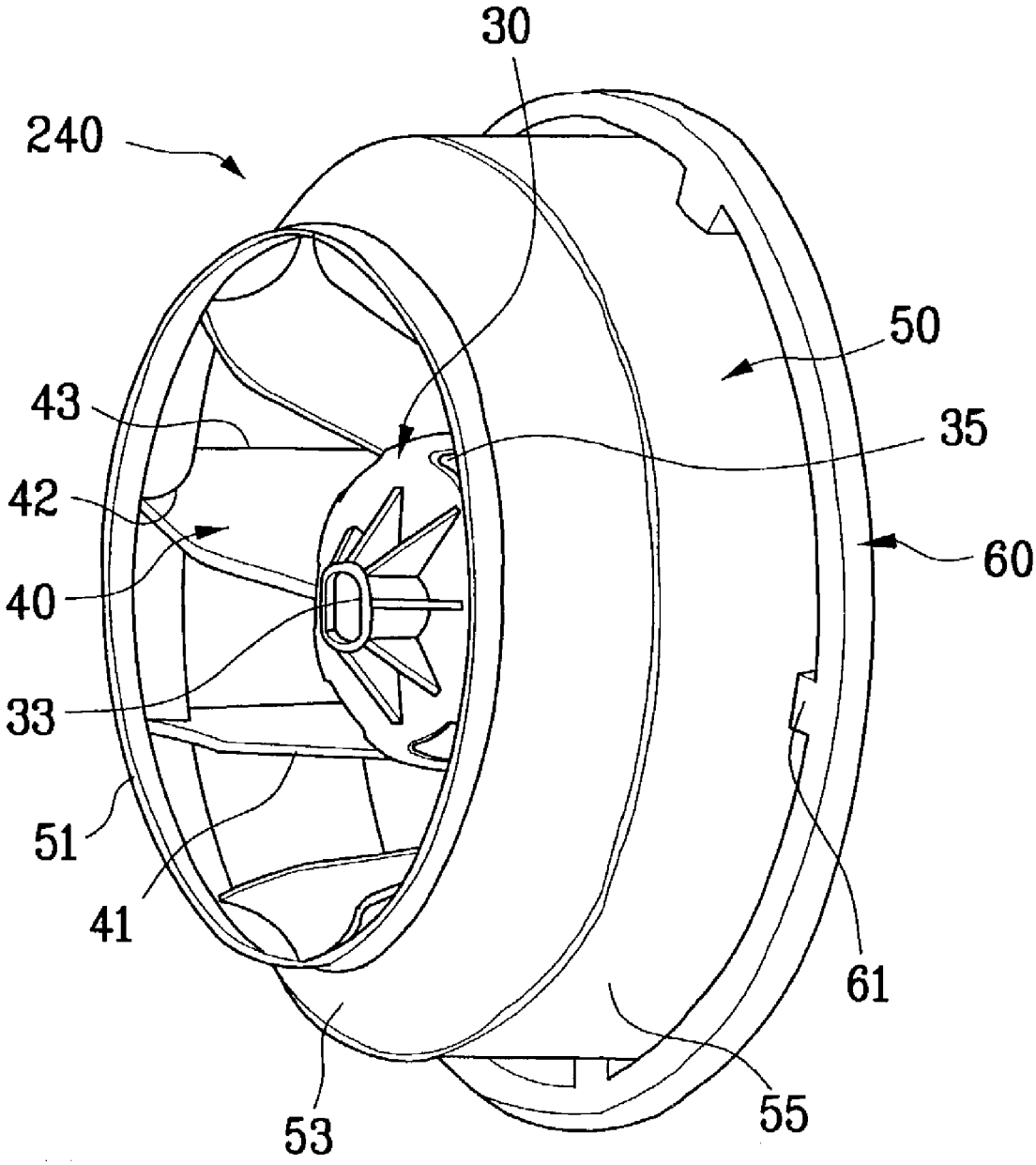
FIG. 8 illustrates a perspective view of a turbo fan for an air conditioner in FIG. 7.

An example will be explained, in which the turbo fan of the present invention is applied to the unit type air conditioner as a fan of an outdoor unit. FIG. 7 illustrates a perspective disassembled view of an air conditioner in accordance with a preferred embodiment of the present invention, and FIG. 8 illustrates a perspective view of a turbo fan for an air conditioner in FIG. 7.

Referring to FIG. 7, the air conditioner of the present invention includes a cabinet 110 having a front space in communication with a room, and a rear space in communication with outside of the room, an indoor heat exchanger 140 and an outdoor heat exchanger 200 fitted to an inside of the cabinet 110, and indoor fan 230 and an outdoor fan 240 for forced circulation of air to the heat exchangers 140 and 200, respectively.

The cabinet 110 has opened front, rear, and bottom, a base pan 120 is fitted to the bottom, and a front grill 130 is fitted to the front. The front grill 130 has a suction part 131 for drawing room air, a discharge part 133 for discharging heat exchanged air into the room, and a control panel part 135 for controlling operation of the air conditioner. There is a suction grill 137 fitted to a front of the suction part 131.

There are the indoor heat exchanger 140 and the indoor air guide 150 fitted in succession in rear of the front grill 130. The indoor heat exchanger 140 is fitted on an indoor air guide 150, so that the room air heat exchanges with a working fluid circulating inside of the indoor heat exchanger 140. The indoor air guide 150 has an orifice hole 151 for the air passed through the indoor heat exchanger 140 to pass therethrough, and a discharge guide 153 at a position opposite to the discharge part 133 in the front grill 130. there is a drain structure 155 in a bottom of the indoor air guide 150 for draining condensed water formed in the indoor heat exchanger 140.

There is a scroll in rear of the indoor air guide 150. The scroll 160 has a flow guide surface 161, for guiding the air flow produced by the indoor fan 230. The scroll 160 may be fabricated as one unit with the indoor air guide 150. There is a control box 170 fitted to pass through the indoor air guide 150 and the scroll 160. The control box 170 has various electric fittings fitted therein.

There is a barrier 180 in rear of the scroll 160 in contact therewith so as to make perfect partition of a front space and a rear space, for isolating the room air from the external air. The scroll 160 or the indoor air guide 150 may replace service of the barrier 180.

There is a motor mounter 21 in rear of the barrier 180. The motor mounter 210 is seated on the base pan 120, and supports the motor 220. The motor 220 has one driving shaft 221, and 223 for driving the indoor fan 230 and the outdoor fan 240 in common. Therefore, a front driving shaft 221 in the driving shaft is passed through the barrier 180, extended to an inside of the scroll 160, and coupled to the indoor fan 230, and an a rear driving shaft 223 is coupled to the outdoor fan 240. After making the room air to flow toward the indoor heat exchanger 140 forcibly, the indoor fan 230 guides a heat exchanged air to the discharge guide 153. For this, a general turbo fan is employed as the indoor fan 230.

The outdoor fan 240 is a turbo fan having a characteristic of an axial fan. Structure and operation of the outdoor fan 240 will be explained in detail, later.

There are an outdoor air guide 190 and the outdoor heat exchanger 200 fitted in succession in rear of the barrier 180. The outdoor air guide 190 has an opening 191 for fitting the outdoor fan 240, and serves to provide the air from the outdoor fan 240 to the outdoor heat exchanger 200 uniformly. The outdoor fan 240 has an inlet faced to the motor 220, and an outlet faced to the outdoor heat exchanger 200. The outdoor heat exchanger 200 is mounted on the base pan 120, and the external air heat exchanges with the working fluid circulating inside of the outdoor heat exchanger 240. There are a cover 193 over the outdoor air guide 190, and a brace 195 over the outdoor air guide 190 and the indoor air guide 150 for firm fastening of the outdoor air guide 190 and the indoor air guide 150.

Though not shown, there are a compressor and an expansion valve of a refrigerating cycle in rear of the barrier 180.

Referring to FIG. 8, the outdoor fan 240 includes a hub 30 having the rear driving shaft 223 of the motor coupled thereto, the shroud 50 accommodated in the hub 30 having the inlet and the outlet, and the plurality of blades 40.

Structures and operation of the hub 30, the shroud 50, and the blades 40 are identical to the same of the turbo fan in FIGS. 2–6, of which description will be omitted, accordingly.

In the meantime, there is a slinger ring 60 on an outside circumference of the shroud 50. The slinger ring 60 splashes condensed water toward the outdoor heat exchanger 200 when the shroud 50 rotates, for enhancing a heat exchange efficiency of the outdoor heat exchanger 200. To do this, the slinger ring 60 has an inside diameter greater than the outside diameter of the outlet part 55 of the shroud 60, and coupled with the outlet part 55 by means of separate coupling legs 61. The slinger ring 60 is submerged in the condensed water formed at the indoor heat exchanger 200 or the outdoor heat exchanger 140.

The operation of the air conditioner of the present invention will be explained.

The air conditioner of the present invention is mounted on a wall such that the front space of the cabinet 110 faces room, and rear space thereof faces outside of the room.

When power is provided to the motor 220, both the indoor fan 230 and the outdoor fan 240 are driven, so that room air and external air circulate through the indoor heat exchanger 140 and the outdoor heat exchanger 200, forcibly. Then, after being heat exchanged with the working fluids passing through the heat exchangers 140, and 200 respectively, the room air and the external air are again discharged to the room and the outside of the room through preset passages, respectively.

It will be explained, in detail. The indoor fan 230 is a general turbo fan. Accordingly, the room air is drawn in an axial direction and discharged in a centrifugal direction of the indoor fan 230. That is, the room air passes through the suction grill 137, the front grill 130, and the indoor heat exchanger 140. Then, the room air passes the indoor air guide 150, and is drawn into the indoor fan 230. Thereafter, the room air flows along the flow guide surface 161 of the scroll 160, passes the indoor air guide 150 and discharged through the discharge part 133 in the front grill 130.

Next, the outdoor fan 240 is a turbo fan having a characteristic of an axial fan. Accordingly, the external air is drawn, and discharged in the axial direction of the outdoor fan 240. That is, after being drawn into an inside of the cabinet 110 through openings 111 in both sides and a top of the cabinet 110, the external air is drawn into the inlet of the outdoor fan 240. Then, the external air is discharged to the outdoor heat exchanger 200 through the outlet of the outdoor fan 240, passed the outdoor heat exchanger 200, and discharged to outside of room through a rear surface of the cabinet.

During this process, the slinger ring 60 of the outdoor fan 240 rotates, and splashes the condensed water to the outdoor heat exchanger 200.

As has been explained, the turbo fan and the air conditioner having the same applied thereto have the following advantages.

First, the turbo fan of the present invention is a turbo fan having a flow characteristic of an axial fan. Accordingly, the turbo fan of the present invention has the advantages of the axial fan and a turbo fan. That is, the turbo fan of the present invention can be used without a flow guide member, such as scroll, and has a relatively high efficiency and low noise compared to the axial fan.

Second, the turbo fan of the present invention has blades in each of which a backward curved blade and a forward curved blade are harmonized appropriately. Therefore, the turbo fan has a low fan load while providing a high flow rate.

Third, the turbo fan of the present invention permits to mold the hub, the blades, and the shroud as one unit. Therefore, fabrication of the turbo fan is simple, and costs low.

Fourth, the air conditioner of the present invention having the turbo fan of the present invention applied thereto as an outdoor fan can provide a comfortable room environment by reducing noise, and reduce power consumption.

It will be apparent to those skilled in the art that various modifications and variations can be made in the turbo fan and an air conditioner having the same applied thereto of the present invention without departing from the spirit or scope of the invention. Thus, it is intended that the present invention cover the modifications and variations of this invention provided they come within the scope of the appended claims and their equivalents.

What is claimed is:

1. A turbo fan comprising:

a hub having a boss coupled to driving means;

a plurality of blades arranged along an edge of the hub at fixed intervals, each having a part of an inner side end thereof connected to the edge; and a shroud having an inlet, an outlet, and a wall between the inlet and the outlet formed to enclose at least a part of an outer side end of each of the blades for inducing an air discharge direction the same with an axial direction of the driving means.

2. A turbo fan as claimed in claim 1, wherein the hub includes;

a cone part projected toward the inlet of the shroud having the boss at a fore end, and a hollow part in a back surface of the cone part in communication with the outlet of the shroud.

3. A turbo fan as claimed in claim 2, wherein the hub further includes at least one opening for making a front side of the hub and the hollow part in communication.

4. A turbo fan as claimed in claim 1, wherein the inlet of the shroud has an inside diameter smaller than an inside diameter of the outlet.

5. A turbo fan as claimed in claim 1, or 4, wherein the inlet of the shroud has an inside diameter formed equal to, or greater than an outside diameter of the hub.

6. A turbo fan as claimed in claim 5, wherein the hub, the blades, and the shroud are molded as one unit.

7. A turbo fan as claimed in claim 1, wherein the shroud encloses entire outer ends of the blades.

8. A turbo fan as claimed in claim 1, or 7, wherein the shroud includes;

an inlet part forming an inlet opening, an outlet part forming a discharge opening and enclosing an outside surface of the blades, and a sloped part between the inlet part and the outlet part.

9. A turbo fan as claimed in claim 8, wherein the shroud further includes a stepped part of a width perpendicular to the inlet part between the inlet part and the sloped part.

10. A turbo fan as claimed in claim 8, wherein the sloped part is a curved surface having a curvature.

11. A turbo fan as claimed in claim 1, wherein the blade includes a backward curved blade in the inlet side, and a forward curved blade in the outlet side.

12. A turbo fan as claimed in claim 11, wherein the blades include the backward curved blade up to 40–80% from a fore end of the inlet side.

13. A turbo fan comprising:

a cylindrical hub having one face opened, and the other face with a boss coupled to driving means;

a shroud having opposite inlet and outlet, and accommodating the hub therein; and a plurality of blades arranged between the hub and the shroud in a radial direction at fixed intervals, each having a part of an inside surface connected to an outside circumferential surface of the hub and an entire outside surface connected to an inside circumferential surface of the shroud.

14. A turbo fan as claimed in claim 13, wherein the hub includes at least one opening for making the inlet and the outlet of the shroud in communication.

15. A turbo fan as claimed in claim 13, wherein the shroud includes;

a ring form of inlet part to form an inlet, a sloped part extended in a direction diverged outward from the inlet part having a curved surface with a curvature, and an outlet part extended from the sloped part parallel to an axial direction to form the outlet, having outer ends of the blades connected thereto.

16. A turbo fan as claimed in claim 15, wherein the shroud includes;

a stepped part of a width perpendicular to the inlet part between the inlet part and the sloped part.

17. A turbo fan as claimed in claim 15, wherein the inlet part of the shroud has an inside diameter smaller than an inside diameter of the discharge part, and equal to, or greater than an outside diameter of the hub.

18. A turbo fan as claimed in claim 17, wherein the hub, the blades, and the shroud are molded as one unit.

19. A turbo fan as claimed in claim 13, wherein the blade includes a backward curved blade in an inlet side, and a forward curved blade in an outlet side.

20. An air conditioner comprising:

an indoor heat exchanger for heat exchange with room air;

an indoor fan for making the room air to flow toward the indoor heat exchanger forcibly;

an outdoor heat exchanger for heat exchange with external air; and an outdoor fan for making the external air to flow toward the outdoor heat exchanger forcibly, wherein at least one of the fans is a turbo fan for drawing, and discharge of air in an axial direction.

21. An air conditioner comprising:

a cabinet having one space in communication with a room, and the other space in communication with an outside of the room;

an indoor heat exchanger fitted in the one space of the cabinet for heat exchange with room air;

an indoor fan fitted in the one space of the cabinet for making the room air to flow toward the indoor heat exchanger forcibly;

an outdoor heat exchanger fitted in the other space of the cabinet for heat exchange with external air; and a turbo fan fitted in the other space of the cabinet for drawing, and discharge of air in an axial direction to make the external air to flow toward the outdoor heat exchanger, forcibly.

22. An air conditioner as claimed in claim 20, or 21, wherein the turbo fan includes;

a hub having a boss connected to driving means;

a plurality of blades arranged along an edge of the hub at fixed intervals, each having a part of an inner side end thereof connected to the edge; and a shroud having an inlet, an outlet, and a wall between the inlet and the outlet formed to enclose at least a part of an outer end of each of the blades for inducing an air discharge direction the same with an axial direction of the driving means.

23. An air conditioner as claimed in claim 22, wherein the hub includes;

a cone part projected toward the inlet of the shroud having the boss at a fore end, and a hollow part in a back surface of the cone part in communication with the outlet of the shroud.

24. An air conditioner as claimed in claim 23, wherein the hub further includes at least one opening for making a front side of the hub and the hollow part in communication.

25. An air conditioner as claimed in claim 22, wherein the inlet of the shroud has an inside diameter smaller than an inside diameter of the outlet.

26. An air conditioner as claimed in claim 22, wherein the inlet of the shroud has an inside diameter formed equal to, or greater than an outside diameter of the hub.

27. An air conditioner as claimed in claim 26, wherein the hub, the blades, and the shroud are formed as one unit.

28. An air conditioner as claimed in claim 22, wherein the shroud encloses entire outer ends of the blades.

29. An air conditioner as claimed in claim 22, wherein the shroud includes;

an inlet part forming an inlet opening, an outlet part forming a discharge opening and enclosing an outside surface of the blades, and a sloped part between the inlet part and the outlet part.

30. An air conditioner as claimed in claim 29, wherein the shroud further includes a stepped part of a width perpendicular to the inlet part between the inlet part and the sloped part.

31. An air conditioner as claimed in claim 29, wherein the sloped part is a curved surface having a curvature.

32. An air conditioner as claimed in claim 22, further comprising a slinger ring fitted along an outside circumferential surface of the shroud for splashing condensed water to the outdoor heat exchanger when the shroud is rotated.

33. An air conditioner as claimed in claim 22, wherein the blade includes a backward curved blade in the inlet side, and a forward curved blade in the outlet side.

34. An air conditioner as claimed in claim 21, further comprising a motor fitted between the indoor fan and the turbo fan having a driving shaft fitted to the indoor fan and the turbo fan in common.

* * * * *